United States Patent [19]

Karagoz et al.

[11] Patent Number: 4,513,425

[45] Date of Patent: Apr. 23, 1985

[54] COMPOSITE ELECTRODE FOR ARC FURNACE

[75] Inventors: Berch Y. Karagoz, Grand Island; Martin M. Turban, Lewiston; Lyman T. Moore, Niagara Falls; Mark D. Travers, Ransomville, all of N.Y.

[73] Assignee: Great Lakes Carbon Corporation, New York, N.Y.

[21] Appl. No.: 514,266

[22] Filed: Jul. 15, 1983

[51] Int. Cl.[3] ..... H05B 7/06

[52] U.S. Cl. ..... 373/88; 373/90; 373/93

[58] Field of Search ..... 373/91, 92, 93, 88, 373/82, 90

[56] References Cited

U.S. PATENT DOCUMENTS 1,018,003 2/1912 Redlich ..... 373/92
3,588,307 6/1971 Kegel et al. ..... 373/88

FOREIGN PATENT DOCUMENTS 77513 4/1983 European Pat. Off. ..... 373/93

*Primary Examiner*—A. D. Pellinen
*Assistant Examiner*—Susan A. Steward
*Attorney, Agent, or Firm*—Adrian J. Good

[57] ABSTRACT

A composite water-cooled electrode for electric arc steel furnaces comprises a tubular graphite body held in compression by means of tension stressed internal water supply pipe located between a metal header at one end and a hollow metal nipple at the other end of the electrode.

13 Claims, 4 Drawing Figures

COMPOSITE ELECTRODE FOR ARC FURNACE

DESCRIPTION

This application is related to Ser. No. 514,267 also filed July 15, 1983 by Turban et al.

BACKGROUND OF THE INVENTION

1. Field of the Invention.

The Invention relates generally to an electrode for electric arc furnaces, and particularly to a composite electrode comprising a liquid-cooled long-lived but consumable upper portion attached to a conventional electrode (or consumable tip portion) joined to the upper portion by liquid-cooled connection means.

2. Description of the Prior Art.

The conventional material employed in electrodes for electric arc furnaces is graphite. These electrodes are consumed in use, for example in electric arc steel making furnaces, due to erosion and corrosion caused by oxidation, sublimation, spalling and other factors. This consumption involves tip losses, column breakage losses and particularly surface oxidation losses. An average electric furnace consumes four to eight kilograms of graphite per metric ton of steel produced.

One method for reducing the consumption of graphite electrodes in arc furnaces has been the application of a protective coating or cladding material to the electrodes with oxidation resistant materials. These coatings generally increase the contact resistance to the electrode power clamp, and some are corrosive, as they are based on phosphoric acid. Consequently, they have not found wide acceptance.

Another means for reducing graphite electrode consumption involves the utilization of fully nonconsumable electrode systems. These systems employ full length liquid-cooled electrodes with selected apparatus to protect the electrode from the extreme temperatures of the arc. Although such systems appear in patent literature, this type has not been commercially successful.

It has been suggested heretofore that composite electrodes comprising carbon or graphite portions attached to a water-cooled metallic piece would provide means for reducing electrode consumption in arc furnaces. A number of patents have issued on specific composite electrode designs. For example, U.S. Pat. Nos. 896,429 to Becket; 2,471,531 to McIntyre et al.; 3,392,227 to Ostberg; 4,121,042 and 4,168,392 to Prenn; 4,189,617 and 4,256,918 to Schwabe et al.; and 4,287,381 to Montgomery relate to liquid cooled composite electrodes for arc furnaces. Likewise, European patent application Nos. 50,682; 50,683; and 53,200 by C. Conradty, Nurnburg are directed to composite electrode configurations.

OBJECTS OF THE INVENTION

It is the objective of the invention to provide an improved composite electrode for electric arc furnaces.

It is a further objective of the invention to provide a composite electrode wherein consumption of the graphite is substantially reduced.

It is a further objective of the invention to provide a composite electrode which is able to resist the harsh environment of an arc furnace and thereby have a long useful life.

It is a still further objective of the invention to provide a composite electrode which will be useful as a consumable electrode after failure as a permanent electrode.

It is a further object of this invention to provide a composite electrode which takes full advantage of the strength in compression of graphite.

SUMMARY OF THE INVENTION

The invention is essentially a composite water-cooled electrode comprising a graphite heavy-walled tubular body having a central bore, a water supply pipe within the bore, a hollow metal nipple located at the furnace end of the tubular body for attachment of a conventional graphite electrode, a metal header at the upper end of the tubular graphite body, a liquid coolant supply system to cool said body and said nipple, and a system holding the tubular graphite main body of the electrode in compression, thereby increasing the resistance to breakage of the graphite.

The tubular graphite main structure body is made from a graphite arc furnace electrode with a threaded socket at each end. The central bore wall is preferably sealed to prevent water leakage and infiltration into or through the graphite wall. The exterior surface of the body may be treated with an anti-oxidant either by coating or impregnation; however, this is not always necessary. The electrode is normally drilled out with a center hole with a diameter not more than the minor diameter of the socket, leaving a heavy wall thickness preferably at least about $\frac{1}{4}$ of the outside diameter of the tube. The metal connecting nipple is hollow. A coolant supply pipe having an outside diameter (OD) smaller than the inside diameter (ID) of the electrode leads into the cavity from a header bringing coolant into the nipple through the center of the main tube. The coolant then returns header. A flat spring, e.g., a Belleville washer, is preferred; but, upward to the outlet at the header through the annulus between the coolant inlet tube and the bore of the main structure. The header is normally attached to the top of the graphite tube by the socket threads in the upper end of the main tube.

The coolant supply pipe is also used as the means whereby compression is applied to the main tube. The pipe is attached to the nipple and the header and held in tension by a tensioning device at the header. A flat spring, e.g., a Belleville washer, is preferred; but other tensioning devices such as coil springs, air or hydraulic cylinders may also be used, and the invention is not limited to any one means of applying tension.

The inner bore of the tube may be coated with a sealant to eliminate leakage and infiltration of water through the graphite. A two-package epoxy coating is preferred but other water-resistant surface coatings such as phenolic, alkyd, silicone, polyurethane, polyester or acrylic resins may also be used.

This electrode is highly resistant to the heat and aggressive atmosphere of the electric arc furnace and the top portion of the attached consumable electrode in the furnace stays dark in use indicating efficient cooling to a temperature lower than the oxidation temperature, with consequent lessening of oxidation and lower graphite consumption per unit of metal produced, than when using the normal all-graphite solid electrodes.

This electrode also consumes less electricity than prior metal composite electrodes due to the absence of inductive heating losses or parasitic eddy currents which were noted to constitute a high drain on the arc current and to present a large heat loss to the cooling system.

It is a further advantage of the electrode of this invention that when the main structure deteriorates after long service, it may be disassembled, the metal parts used with a new graphite tube, and the failed piece consumed as an electrode in the normal manner.

It is a further advantage that the electrode has a greatly increased strength as compared to an all-graphite column without compression.

Figure 1:
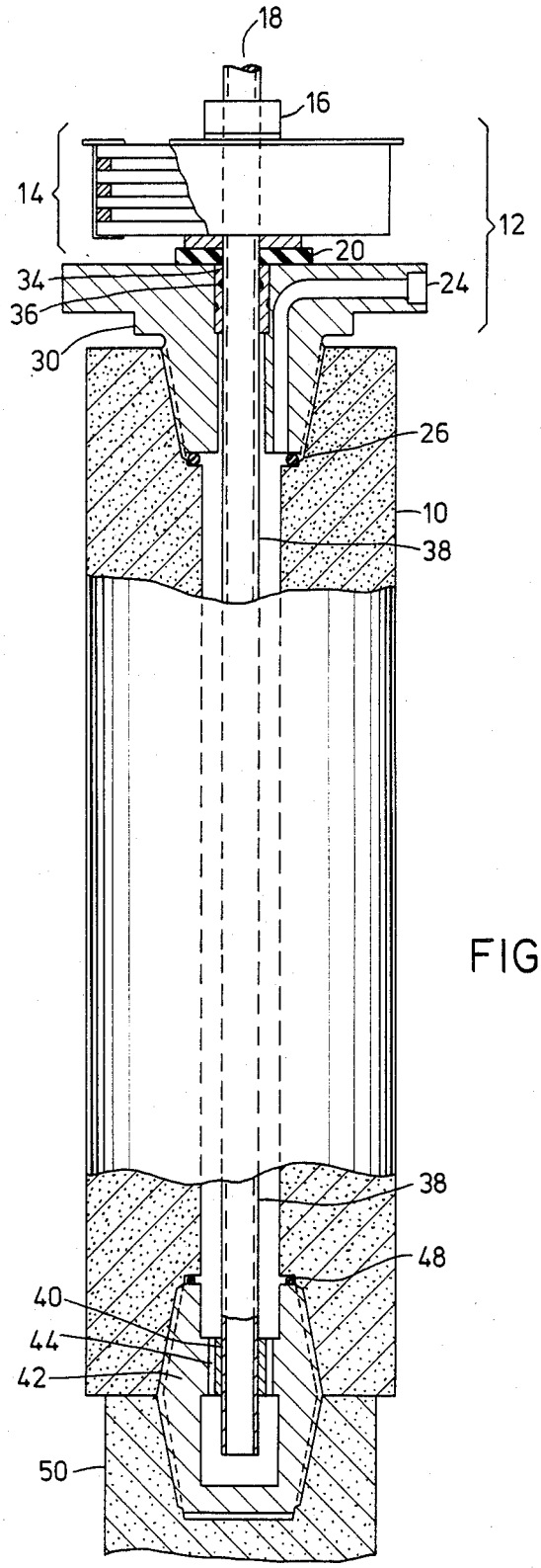
FIG. 1 shows the complete electrode comprising main graphite tube 10, header assembly 12 consisting of Belleville spring washer assembly 14, nut 16, water inlet 18, isolator washer 20, water outlet 24, upper O-ring seal 26, water inlet tube 38, header nipple 30, and isolator seal bushing 34, with O-rings 36. At the lower end of the column are water inlet tube 38 held in place by threaded spider 40, hollow water cooled metal nipple 42, return coolant passage 44 in spider 40, lower O-ring seal 48 and conventional graphite tip electrode 50.

Graphite main tube 10 is held in compression by tension, applied through nut 16 to Belleville washer springs 14, to water inlet tube 38 held in nipple 42 by spider 40. The tension applied to water inlet tube 38 results in an upward thrust or force moment by the nipple against the lower socket of electrode body 10 and also puts the upper part of nipple 42 in compression. Water enters at inlet 18, passes through water inlet tube 38 to the interior of nipple 42, returning through the passages 44 in spider 40 to the annulus between water inlet tube 38 and main tube 10 to header 12 and outlet 24. The electrode is sealed with O-rings.

Figure 2:
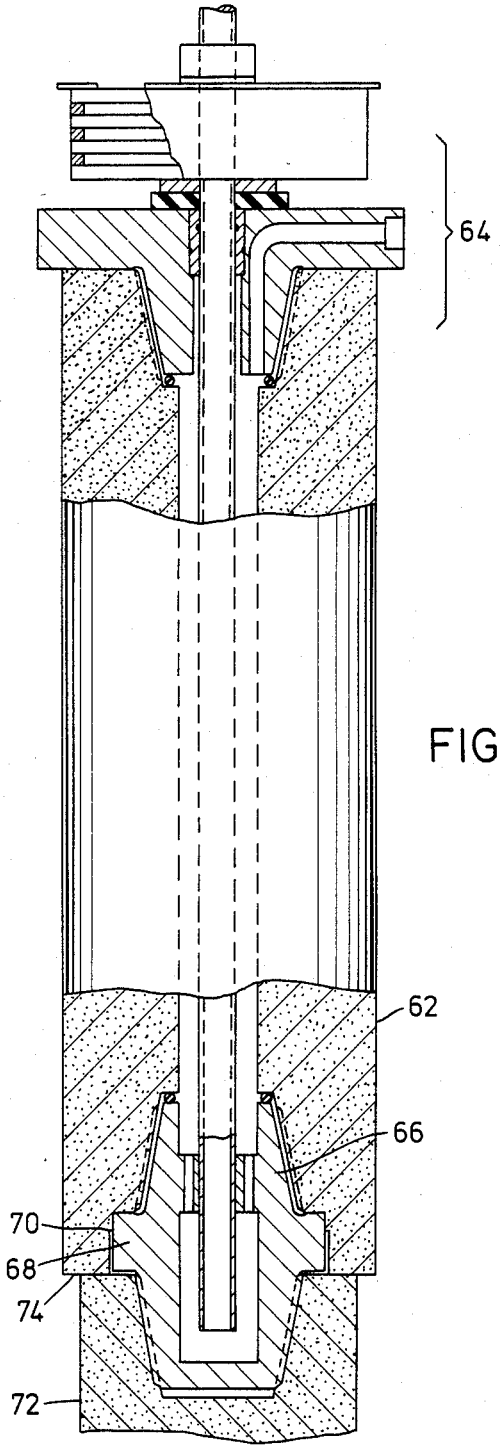

FIG. 2 depicts another version with electrode 62, header assembly 64 and nipple 66 with flange 68 housed in counterbore 70, holding the electrode in compression while allowing facial contact of lower electrode 72 with electrode 62 at interface 74.

Figure 3:
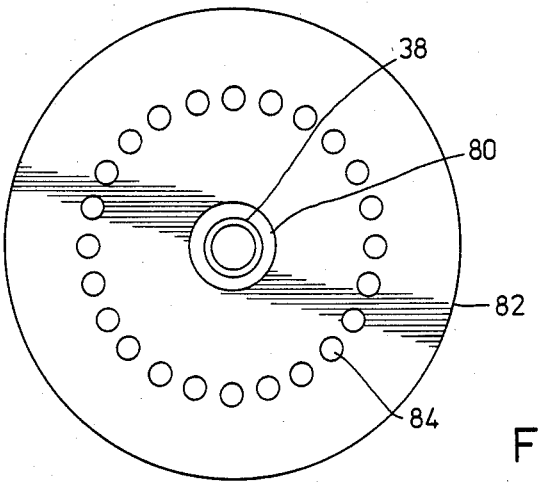
Figure 3A:
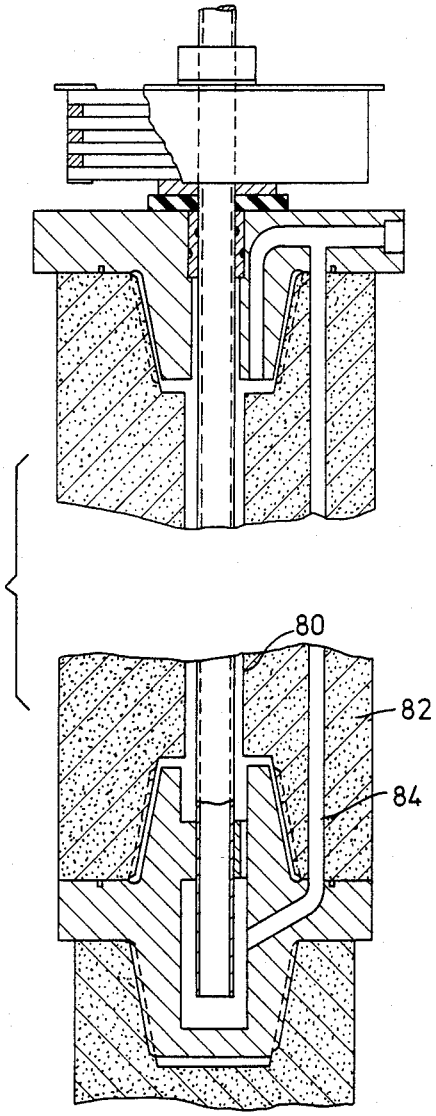

FIGS. 3 and 3A depict a variation of the invention wherein the bore 80 of the main graphite tube 82 may also serve as the coolant inlet and radially distributed passages 84 serve as the coolant outlets through the graphite closer to the surface for more efficient cooling.

The nipple, water inlet tube, and header assembly may be made of any suitable metal such as steel, gray iron, ductile iron, aluminum, copper or stainless steel. Aluminum is preferred for the header and water inlet tubes for its low cost and light weight, while copper, gray iron, ductile iron, or Invar are preferred for the nipple. If the unit fails catastrophically in service, the addition of a gray iron or ductile iron nipple to the heat will not adversely affect the melt analysis, as may occur if the nipple is made of copper, Invar or aluminum.

The main tube is preferably a graphite having a CTE of less than $15\times10^{-7}$ over the range of 0° to 50° C.; otherwise, it may fail from thermal shock.

The CTE of an electrode varies between the longitudinal and transversing directions due to the crystal orientation of the graphite introduced during extrusion. The CTE figure used here is in the transverse direction normal to the long axis of the cylinder.

The exterior of the main tube 10 may be coated with an antioxidant coating such as disclosed in co-pending application Ser. No. 442,651 filed Nov. 18, 1982 by Wilson.

DESCRIPTION OF THE PREFERRED EMBODIMENT

An electrode was made by boring a 4" in. (10 cm) hole in the center of 16 in. diam. (41 cm) ×80 in. (203 cm) graphite electrode and coating the bore with a sealant. The electrode had two threaded truncated conical sockets of the type normally used in the electrode industry. A header assembly including a threaded adapter nipple, O-ring seals, Belleville flat spring washer assembly, tensioning nut, water inlet pipe, and water outlet were attached at the upper end and a hollow threaded biconical nipple attached to the coolant pipe was attached at the lower end. Tension may be applied to the coolant supply pipe by the tensioning nut, placing the graphite electrode under a substantial compressive force of 25 psi. Graphite has a high compressive strength, and can withstand a high stress in compression. The breaking strength of socket threads limits the amount of compressive stress such that the useful stress is much lower than the ultimate stress limits. A 14 in. (36 cm) solid graphite electrode may be attached to the nipple. The electrode is then ready for water hookup and placement in the furnace lamp.

The coolant supply pipe was stainless steel and the header assembly in this instance was aluminum; however, they could be made from other materials with the required tensile strength. The nipple was copper, but might also have been high-strength graphite, ductile iron, gray iron, steel, aluminum, copper, Invar 36 or other low CTE materials.

The electrode string is attached to the nipple in an off-furnace location, positioned in the furnace clamp, and coolant connections made to the inlet and outlet pipes at the header. The increased strength realized by this electrode is particularly useful in some furnaces which use long electrode strings, e.g., three eight foot long electrodes in some furnaces with high roofs.

The problems involved in the metal-structured composite electrodes of arcing at the nipple are overcome in this design by the interchangeability of the metal nipple, which permits easy substitution in case of failure.

Although the perferred embodiment of the electrode has the standard truncated conical threaded sockets at each end identical to those universally used in electric furnaces, fitting the standard biconical nipple, the header and nipple could be attached by other means and the invention is not limited to any specific configuration. The two ends could easily be machined in entirely different manners and the attachments likewise assembled in different manners.

The natural frequency of this design with the graphite in compression, is relatively high, and the column has very low tendency to split due to vibration or oscillation.

The nipples may, of course, be made of a suitable metal such as copper, titanium or ferrous alloy, but may also comprise several materials, e.g., a copper-ferrous combination for good conductivity, low cost, high strength and low CTE.

Invar is a nickel alloy with an essentially zero CTE and is described in the *ASM Handbook,* 9th Ed., as being composed of 36% Ni, less than 1% of Mn, Si, and C combined, and the remainder (63%) Fe.

Most arc furnaces have severely limited working space above the electrodes, making the Belleville washer falt spring tensioning system preferred for its small size and simplicity. A Belleville flat spring washer is a well-known spring manufactured by a large number of suppliers and consists of an elastic dished washer of spring steel.

The minimum electrode wall thickness is determined by the differential between the outside diameter of the electrode and the maximum socket base diameter.

We claim:

1. A water-cooled composite tubular electric furnace electrode having a hollow graphite body component with a central bore having a coolant supply pipe therein attached to a header assembly at one end, a hollow nipple at the other end, said coolant supply pipe utilized to create a compressive force on said electrode by tension between said header and said nipple prestressing said graphite body component.

2. The electrode of claim 1 wherein the means for prestressing said electrode comprise a spring and nut assembly on the header assembly, and a central coolant supply pipe in tension attached to the nipple.

3. The electrode of claim 1 wherein the coolant supply means comprises a pipe which has an outer diameter substantially smaller than the inner diameter of the bore of said electrode, forming a coolant return annulus between said pipe and said bore.

4. The electrode of claim 1 wherein the coolant enters the coolant supply pipe, traverses said pipe to the interior of the nipple, and returns through the coolant return annulus to the header assembly and there exits the electrode.

5. The electrode of claim 1 comprising a graphite tube having a transverse CTE of no more than $15\times10^{-7}$ cm/cm/° C. over the range of 0° to 50° C.

6. The electrode of claim 1 wherein the means for holding the graphite component in compression comprises an assembly of flat spring washers.

7. The electrode of claim 1 wherein the inner bore of the graphite tubular component is sealed with a surface coating.

8. The electrode of claim 1 wherein the compressive force is exerted on the graphite body component through flanges on the header and nipple.

9. The electrode of claim 1 wherein the compressive force is exerted on the graphite body through threads in a socket at each end of said graphite body component.

10. The electrode of claim 1 wherein the compressive force exerted on the electrode is sufficient to overcome the gravitational force of the electrode string and result in an upward force moment of the nipple against the lower socket of said electrode and also put the upper part of the nipple in compression.

11. The electrode of claim 1 placed under $1.7\times10^5$ (25 PSI) of compressive force.

12. In a water-cooled tubular graphite arc furnace electrode having a central bore, the improvement comprising:

a. an electrode wall thickness having a minimum of the differential between the electrode diameter and the maximum socket base diameter;

b. a central inlet pipe having a smaller OD than the ID of said electrode functioning as a water supply and also as a prestressing member whereby said electrode is held in compression;

c. said pipe being attached to a header assembly at the upper end of the electrode;

d. said header having water outlet passage means;

e. said pipe being attached to a hollow nipple located at the lower end of the electrode, said nipple constructed of a metal selected from the group consisting of copper, ductile iron, cast iron, a ferrous alloy, titanium and Invar;

f. said pipe extending into the interior of said nipple;

g. said nipple having coolant passage means connecting with the coolant return annulus between the OD of said pipe and ID of said electrode;

h. said pipe being placed under tension between said header and said nipple, whereby said electrode is held under compressive force.

13. A water-cooled composite tubular electric arc furnace electrode having a graphite body component with a central bore, a header assembly at one end, a hollow nipple at the other end, and a structural member in tension attached to said header and said nipple prestressing said graphite by exerting a compressive force thereon, wherein said central bore serves as coolant supply means, and coolant return means comprise longitudinal passages at a distance radially outward from said central bore.

* * * * *